US005114427A

United States Patent [19]

Damm

[11] Patent Number: 5,114,427

[45] Date of Patent: May 19, 1992

[54] METHOD FOR LEVEL EXHAUST DYEING CELLULOSE FIBER MATERIAL WITH REACTIVE DYES BY THE CONTROLLED ADDITION OF THE FIXING ALKALI WITH A GIVEN PROGRESSION WHICH IS CHANGED BEFORE COMPLETION

[75] Inventor: Sture Damm, Brämhult, Sweden

[73] Assignee: Hoechst Aktiengesellschaft, Frankfurt, Fed. Rep. of Germany

[21] Appl. No.: 596,567

[22] Filed: Oct. 11, 1990

Related U.S. Application Data

[63] Continuation of Ser. No. 262,154, Oct. 17, 1982, abandoned, which is a continuation of Ser. No. 13,626, Dec. 29, 1986, abandoned.

[30] Foreign Application Priority Data

Apr. 29, 1985 [DE] Fed. Rep. of Germany ..... 3515406

[51] Int. Cl.[5] ..... D06P 1/38; D06P 3/66; D06P 5/00

[52] U.S. Cl. ..... 8/400; 8/529; 8/533; 8/543; 8/549; 8/918

[58] Field of Search ..... 8/400, 543, 549

[56] References Cited

U.S. PATENT DOCUMENTS

| | | | |
|---|---|---|---|
| 3,843,318 | 10/1974 | von der Eltz | 8/543 |
| 4,089,644 | 5/1978 | Carbonell et al. | 8/400 |
| 4,314,819 | 2/1982 | Oschatz | 8/630 |
| 4,372,744 | 2/1983 | Hildebrand et al. | 8/400 |
| 4,562,604 | 1/1986 | Damm | 8/158 |
| 4,629,465 | 12/1986 | Hasler et al. | 8/400 |
| 4,645,510 | 2/1987 | Hasler et al. | 8/400 |
| 4,656,846 | 4/1987 | Damm et al. | 68/207 |

FOREIGN PATENT DOCUMENTS

| | | |
|---|---|---|
| 3515407 | 10/1986 | Fed. Rep. of Germany . |
| 609822 | 3/1979 | Switzerland . |
| 1367948 | 9/1974 | United Kingdom . |
| 1465186 | 2/1977 | United Kingdom . |

*Primary Examiner*—A. Lionel Clingman

[57] ABSTRACT

Method for dyeing of cellulose fibers by means of reactive dyeing agents according to the exhaust method. According to the present method one adds the alkali necessary for the fixation of the dyeing agent continuously or substantially continuously over a predetermined time interval so, that an adding process with predetermined progression is not brought to the end, but after a predetermined time is followed by an addition process with a different progression.

12 Claims, 4 Drawing Sheets

METHOD FOR LEVEL EXHAUST DYEING CELLULOSE FIBER MATERIAL WITH REACTIVE DYES BY THE CONTROLLED ADDITION OF THE FIXING ALKALI WITH A GIVEN PROGRESSION WHICH IS CHANGED BEFORE COMPLETION

This case is a continuation of Ser. No. 07/262,154 filed Oct. 17, 1982 and abandoned and which is a continuation of Ser. No. 07/013,626 filed Dec. 29, 1986 and abandoned.

BACKGROUND OF THE INVENTION

Technical Problem

In connection with dyeing cellulose fiber material by means of reactive dyeing agents according to the exhaust method there is often a risk that uneven dyeing will result, especially when using dyeing agents with a high reactivity, once the alkali necessary for the reaction is added to the fibers, the fixation starts with a high velocity and reaches high values within a short time interval. If one plots the fixation values for such a dyeing procedure in percent of the final fixation relative to the dyeing time, one obtains a steep fixation characteristic, at which an unproportionally large part of the added reactive dyeing agent will be fixed during an unproportionally short part of the dyeing time interval. As an example the design paper Levafix-Brillantgelb E-GA of the design schedule LeH1350 from Bayer AG can be mentioned.

In order to secure a high degree of evenness during difficult dyeing conditions, it is necessary to reduce the steep increase of fixation in the initial phase of the dyeing process and to influence the reaction with fibers in such a way, that the fixation proceeds at least approximately proportionally relative to the dyeing time.

This can for example be achieved by adding the alkali not at the optimal dyeing temperature for the reactive dyeing agent in question, but at a lowest possible initial temperature, for example 20° C., then warming slowly up to the dyeing temperature. As the reaction velocity is dependent on the temperature, the fixation will initially be held back, so that the desired more level fixation characteristic can be obtained.

However, this operation has serious disadvantages. In several cases one cannot obtain a sufficiently low initial temperature, as for example in tropical countries, where the temperature of the available water for operation can be considerably higher. In cases of the today widely spread warm dyeing reactive dyeing agents the recommended operation temperature of which lies at 40°-50° C. the measure described is no longer effective, as sufficient temperature difference between initial and dyeing temperature is no longer obtained. Furthermore, low treatment temperatures in many ways counteract the good quality which is desired. For example, various goods made in jet dyeing machines and in winch dyeing machines open in a poor way and tend to be displaced. In cheese dyeing machines the flow through of the bath is prevented when operating at lower temperatures.

However, if one, in order to eliminate said disadvantages, adds the alkali at the optimal dyeing temperature, this must absolutely proceed in portions, as otherwise—as described initially—a too steep fixation characteristic is obtained. These additions must be calculated very carefully and proceed in controlled time intervals in order to avoid sudden fixation jumps, which again result in an uneven dyeing. Such an operation prolongs the dyeing time and reduces the production capacity. Furthermore, this manner of operation calls for increased personnel and involves risk of incorrect operation.

In order to avoid the hitherto known disadvantages further proposals have been made known by means of which the desired evenness, level dyeing will be achieved. In the EP 0-017-805 U.S. Pat. No. 4,372,744 to Hildebrand et al; assigned to Bayer AG it has been proposed to introduce the reactive dyeing agent into the bath, containing electrolyte and alkali in such a way, that less than 10% of the dyeing agent fixed at the end of the dyeing process are present unfixed in reactive form during the dye bath. However, it has not been possible before to introduce this method into the dyeing practice, which partly depends on the fact that continuous measurement/testing of the concentration of the reactive dyeing agent in the dye bath involves extremely high costs (HPLC or by separate serial tests).

An isotermal dyeing method is also known and in which to a bath containing a dyeing agent and electrolyte at dyeing temperature the alkali necessary for the fixation of the reactive dyeing agent has been added automatically and progressively. (EP 0 126 042 which corresponds to U.S. Pat. No. 4,562,604). For realizing this method a computer controlled dosage apparatus is required, which substantially continuously adds the alkali over a predetermined time interval so, that in an initial phase the amount of said alkali is of a small quantity, which during the process is increased progressively until the total quantity of alkali is added.

According to EP 0 126 042 the addition of the dosage process can for example be achieved if the addition of alkali follows an exponential function. By a mathematic mixture with a linear function, different increments can be obtained. (FIG. 4 of EP 0 126 042). The method claimed in EP 0 126 042 has already been positively accepted in the dyeing practice. However, it has appeared that besides all these advantages it has certain disadvantages. In FIG. 1 of the appended drawing a typical fixation characteristic for a sulphatoethylsulphon dyeing agent is shown. However, the characteristic shows a substantially linear extension of the main part of the fixation. However, the curved part of the characteristic at the beginning of the addition and the levelling part of the characteristic at the end of the dyeing time results in an unnecessary prolongation of the dyeing time (compare Ungerman, Textil Praxis International 39 (1984), page 495, FIG. 8). Consequently an unpredictable deviation from the ideal process of the characteristic result occurs. This is shown in FIG. 1 by means of dashed lines. If one follows the previous fixation process one might by means of a change of the beginning and the end of the characteristic addition achieve obvious time saving. Laying the previous need for time as a basis, a clearly more level fixation characteristic mode will be obtained upon an ideal use of this time period and this would result in an improved eveness and/or an improved operation safety. A fixation mode according to FIG. 1 is achieved upon optimal choice of addition increments.

If one adds alkali at initially greater increments, the dyeing time will be reduced within certain limits, however, this will be paid for with undesired more steep fixation process. Then the risk for an uneven dyeing will be considerably increased (compare also Ungermann, Textil Praxis International Vol. 39 (1984) page 495, FIG. 6).

Also upon a reduction of the time for addition the dyeing time will be reduced only upon payment for a more steep process of the characteristic, as the characteristic for the addition will be the same.

From what is said above, it is apparent that when using the previously known and in EP 0 126 042 described progressive addition technique the fixation can apparently not be influenced in such a way that the fixation process follows the ideal mode or follows the same in a better way.

THE INVENTION

It has surprisingly been found, according to the present invention, that the desired improvements of decreasing fixation time while avoiding uneven dyeing, can be achieved by adding the fixing alkali, at a first addition rate during an initial portion of the fixing process, and thereafter abruptly changing to a second rate of addition for the alkali. Each of the first and second rates change in time according to their own separate dosing curve to improve the fixation characteristic during the fixation process over that which was achieved by the prior art.

DETAILED DESCRIPTION OF PREFERRED EXAMPLES

Figure 1:
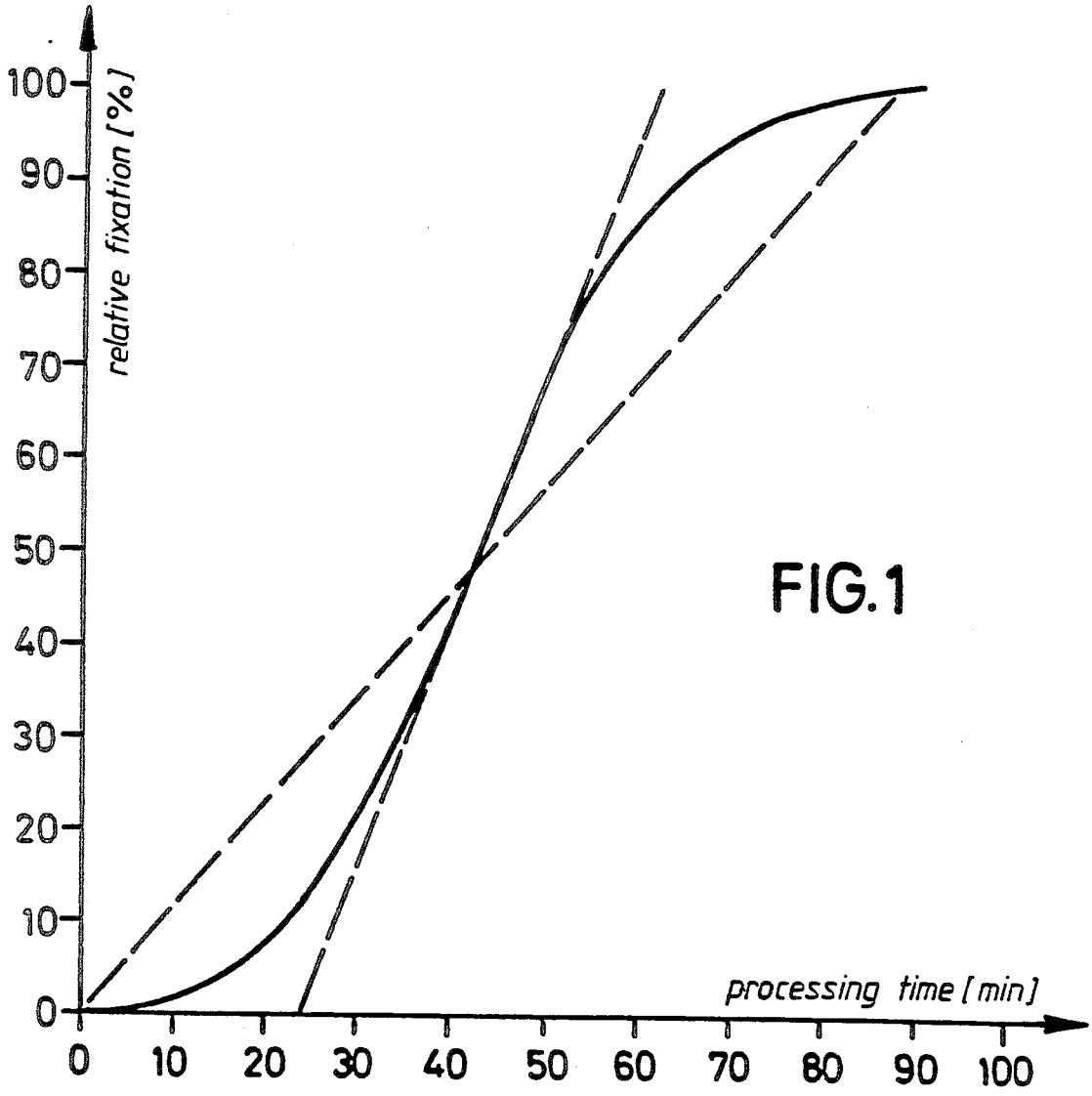
FIG. 1 shows different fixation characteristics.
Figure 2:
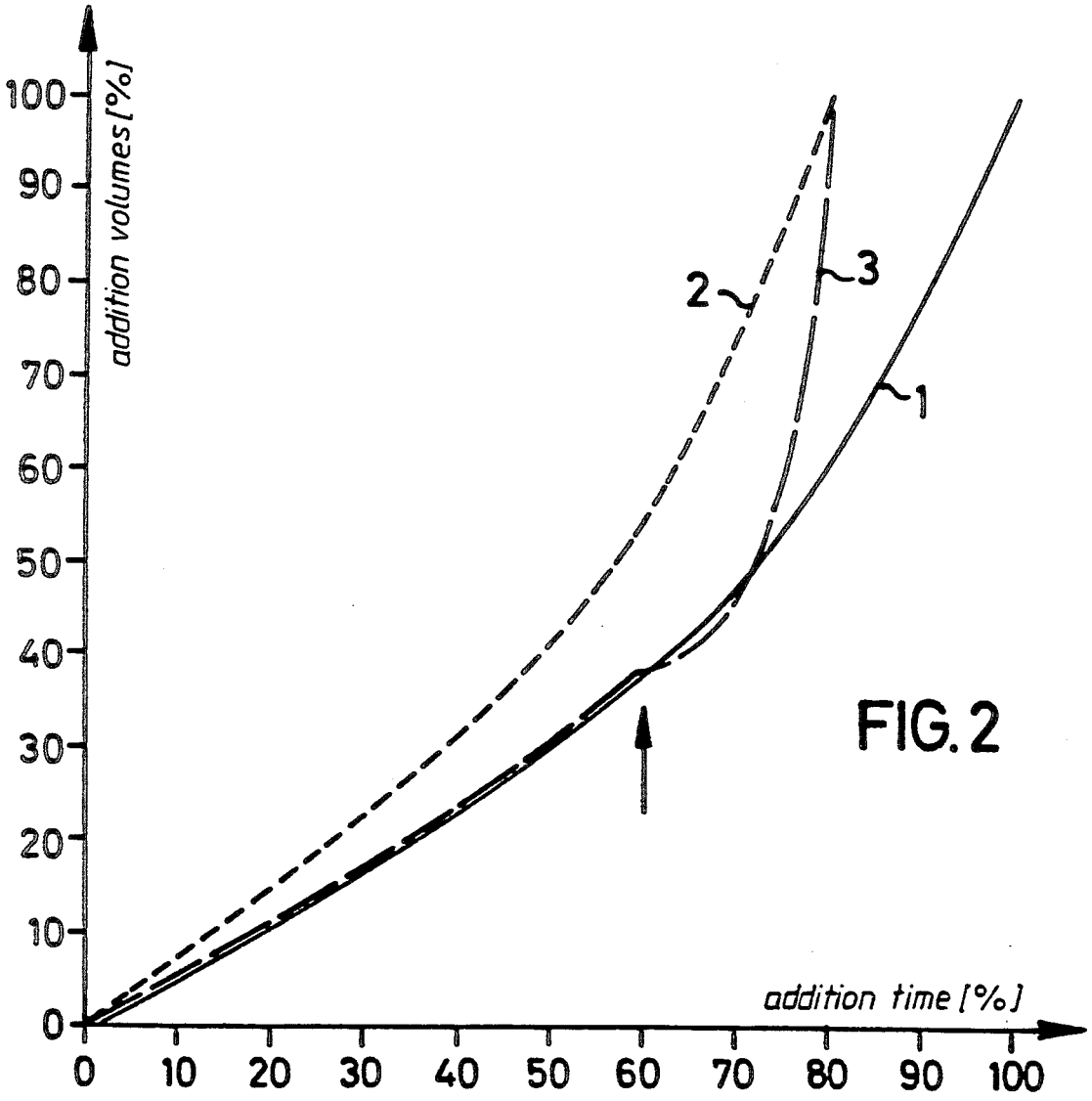
FIGS. 2–4 show combinations of different progressions of the addition characteristics according to the present invention.

In FIG. 2, an addition process for alkali to be added into the exhaust liquor is illustrated, which includes a component having a characteristic curve 1. Curve 1 is formed as a combination of a linear and an exponential function as disclosed in EP 0 126 042, which describes this characteristic curve as being a 50% progressive curve for the addition of alkali during a predetermined time interval. If one chooses 60 minutes as the time interval, that is time interval = 100% shown on the horizontal axis of the graph (FIG. 2) one obtains the fixation characteristic of a sulphatoethylsulphone dyeing agent as shown in FIG. 1.

If one wishes to reduce the addition time to 80% and consequently also the dyeing time, one must use the addition characteristic 2 when maintaining the addition characteristic. However, an undesirable faster fixation process is connected with this reduction of the dyeing time. However, if one combines two different progression characteristics and changes at a total addition time of 80% with it 60% progression, one obtains an addition characteristic 3, which follows the characteristic 1 to a large extent and aims at the maximal value immediately before the end of the addition time interval of 80%. At 70% addition time by use of the characteristic 2 the alkali content would comparatively be more than 50% higher than in connection with the characteristic 3. In this way it is possible to maintain the fixation characteristic according to FIG. 1 to a large extent. The alkali will not until then be added in an accelerated manner over a reduced time interval, when the fixation characteristic tends to level. In this way the fixation characteristic in the upper part achieves a desired extension and the dyeing time will consequently be reduced without causing disadvantages with respect to evenness.

Figure 3:
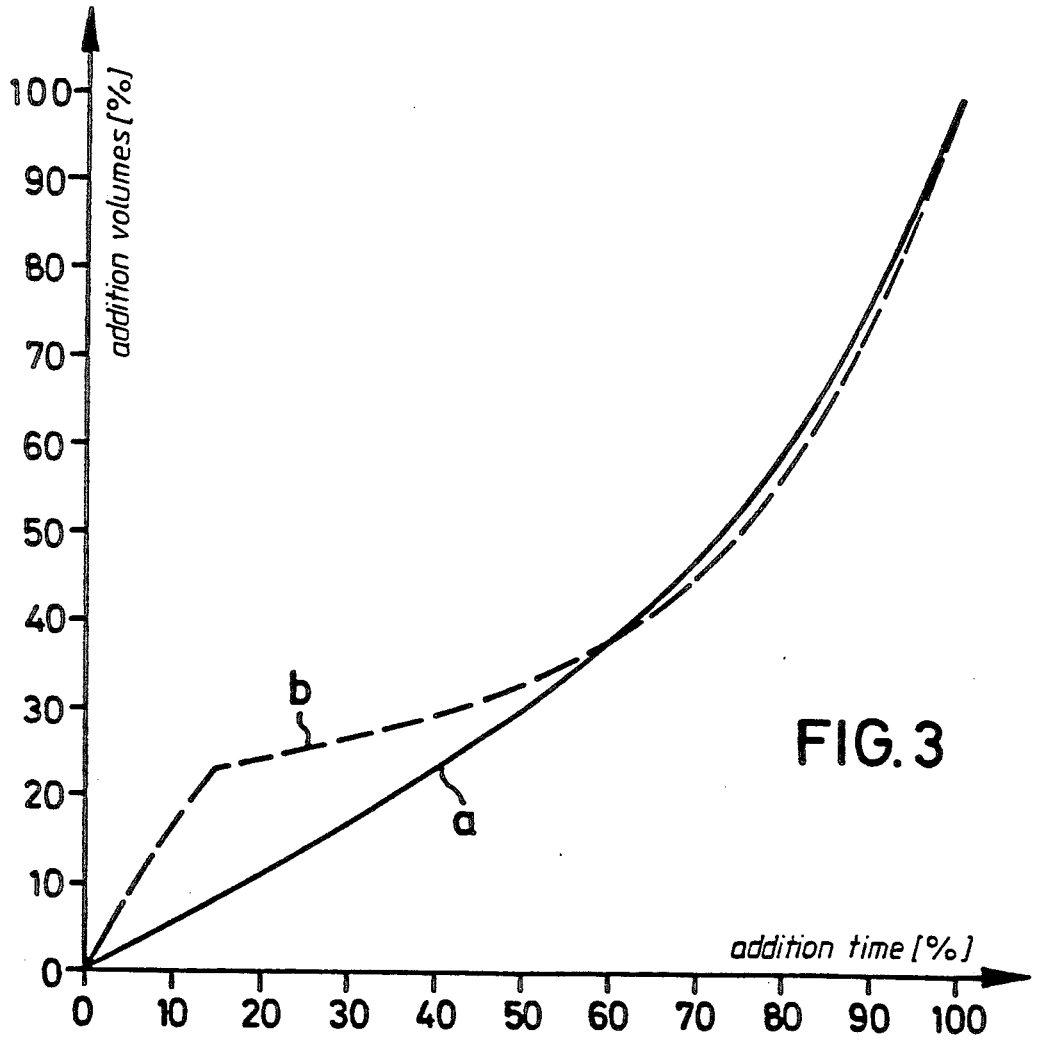

If one initially uses small progressions or if one initially adds with a linear or degressive addition process, one can avoid the initially curved portion of the fixation characteristics shown in FIG. 1. FIG. 3 shows the combination of two characteristics, of which the first characteristic extends over 15% of the total addition time, which it is followed by an addition characteristic with a strong progressivity. In the initial phase extra alkali is added resulting in that the fixation characteristic rises faster. Then the addition of alkali is delayed, until the original addition characteristic again will be followed. Also this measure results in a reduction of dyeing time without disadvantages with respect to the evenness, as the fixation process will not be changed by a degree which is worth mentioning. However, the too slow fixation in the initial phase will be accelerated.

Figure 4:
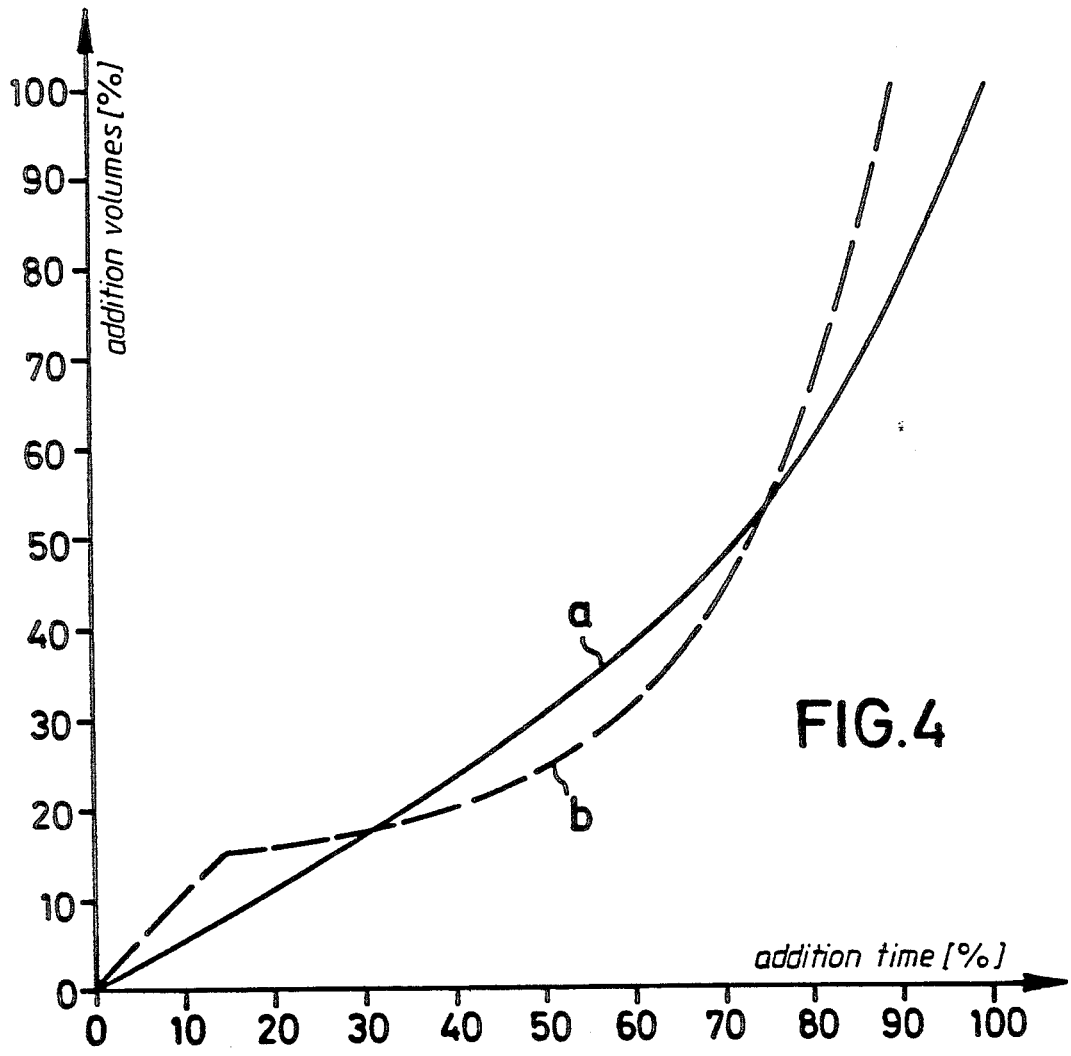

Finally by corresponding combinations of curves having suitable addition characteristics the two modifications of alkali additives described above can be combined with each other. Addition rate is used for a short initial period of time during the first time interval, and this is followed by a strongly progressive addition rate, the advantages of the invention are also achieved. This use of two different dosing rates is shown at curve b in FIG. 4. Curve a is shown in FIG. 4 for the comparison only. As with curve 1 in FIG. 2, curve a represents a progressive curve as defined in EP 0 126 042. In that reference the progressive characteristic is defined as a percentage where a linear function is combined with an expotential function. If the curve is straight and is formed entirely by the linear function, it is said to have a zero percent progression. If the curve is entirely made up of the exponantial function it is said to have a 100% progression. A degressive curve as used in the present application is a curve wherein the rate of addition of the alkali decreases over time. In all progressive functions the rate of addition for the alkali increases over time.

By means of increased addition of alkali in the initial phase the curved portion of the fixation characteristic will be avoided or reduced. As a result of this the fixation characteristic will rise faster. By means of the second addition mode the alkali concentration will be reduced by time relative to the addition characteristic with 50% progression which is considered optimal, used in the previous progressive addition technique according to EP 0 126 042, so that the fixation characteristic shown in FIG. 1 will rise with a smaller gradiant.

The levelling of this more advantageous fixation characteristic towards the end of the dyeing process and consequently an unnecessary time loss will be avoided by means of over-proportionally accelerated addition of alkali over a reduced time interval.

By means of a suitable choice and combination of two addition characteristics, using a suitable moment for change one obtains the possibility to influence the previously not completely satisfactory fixation characteristics in a previously not known and practiced way so, that they will come extremely close to the correctly ideal fixation process.

The method according to the present invention constitutes therefore a clear progress relative to the prior known method. Not until combining two or at least two of the addition characteristics described in EP 0 126 042 according to the present invention, is it possible to vary the addition process within wide limits and control the same so that optimal results with respect to eveness and time consumption will be achieved.

The method according to the present invention can be utilized for dyeing cellulose fibers and mixtures containing cellulose fibers in all states of treatment, for example as waste wool, fleece, fabrics or knittings and in all for the present purpose suitable machines. The reactive dyeing agents to be used in connection with the present method can contain complex forming metals or be free from said metals and be present as mono-, polyazo-, anthrachinon-, formazan-, phtalocyanin-, or oxazin dyeing agents.

They can be mono- or polyfunctional and can for example contain at least one of a monochlortriazin-, dichlortriazin-, dichlorchinoxalin-, trichlorpyrimidin, monochlordifluorpyrimidin-, monofluortriazin-, vinylsulfon-, orvinylsulfonylphenylaminochlortriazin groups, whereas in the last two types the reactive group also can be present in a masked form, that it is say for example as sulphatoethylsulfon or sulphatoethylsulfonylphenylaminochlortriazin respectively.

As alkali all in reactive dyeing utilized alkalies can be used, for example sodium hydroxide, sodium hydrogencarbonate, sodium carbonate, trisodiumphosphate, sodium silicate and the corresponding compounds with other alkali metals, as well as mixtures of said compounds with each other and mixtures with alkali binding agents.

The addition of alkali according to the present invention can be performed by means of for example apparatuses as shown in EP 0 126 042 programmed in such a way to achieve the desired addition characteristics.

The following examples are included to further clarify the present invention.

EXAMPLE 1

A dyeing corresponding to example 1 of the EP 0 126 042 will be accomplished in such a way that at first 300 kg of a fine ripped knitted cotton fabric is treated in a bath relationship of 1:10 in a jet dyeing machine with 2.5% of the CI Nr. 61200 reactive blue RB 19 known for difficult dyeing properties during addition of 50 g/l water free sodium sulphate. After adjustment of the temperature in the bath to 40° C., 2 $cm^3/l$ sodium hydroxide solution 32.5%, diluted to 100 1, is added after a ten minute distribution phase. Contrary to the prior art method, the alkali will not be added during a 60 minutes period with a 60% progression, but instead will be added at a 20% progression initiated and after 15 minutes, the rest of the alkali solution will be added during 30 minutes with a 90% progression, so that the total addition time amounts to 45 minutes. The dyeing will be finished 20 minutes after the completed addition of sodium hydroxide. As a result of the addition process of the invention, a dyeing with excellent evenness will be obtained. The total treatment time for the present invention is only 65 minutes as compared with 90 minutes which was previously required. For a dyeing process in which the alkali is added for 60 minutes according to the prior art, only 60% of the treatment will be completed and 40% more time is required to finish the process then for the present invention.

EXAMPLE 2

If one instead of the cotton goods used in example 1 takes a fabric of 50% cotton and 50% polyester and utilize this instead of C.I. Nr. 61200 Reactive Blue 19 the dyeing agent according to the formula

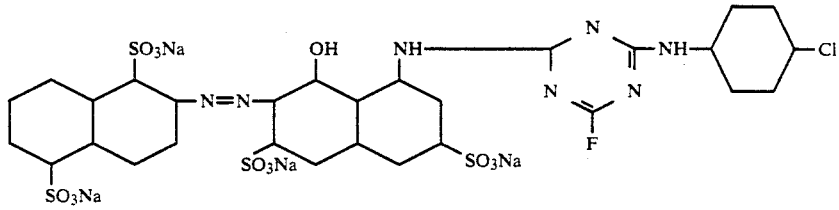

one achieves a completely even red dyeing of the cotton part which by means of an associated over dyeing of the polyester part with conventional dispersion dyeing agents can be changed to a unified tint.

EXAMPLE 3

A yarn dyeing apparatus with a one sided bath circulation will be charged with 500 kg mercerised cotton yarn. The treatment bath consists of 3.200 1 water, in which 175 kg sodium chloride is dissolved. In this base 100 1 of a solution, which contains 5 kg of the dyeing agent and 10 kg of the dyeing agent having the formula

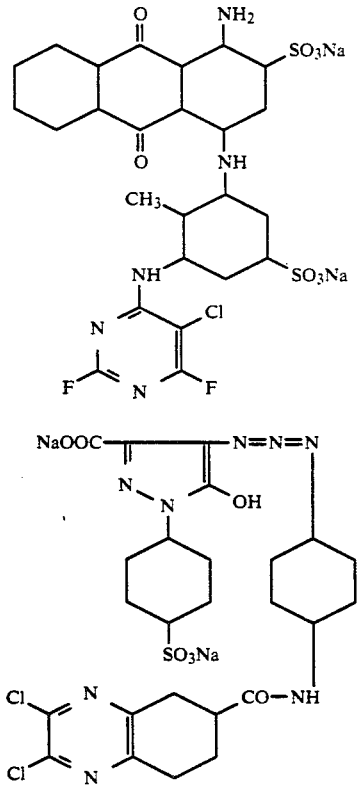

will be introduced over 10 minutes. The dyeing temperature of 50° C. will be controlled and possibly adjusted. Following this 200 l of a solution, which contains 35 kg of tripotasium phosphate-7 hydrate in is added such a way that by means of a programme controlled piston pump initially during 20 minutes a linear addition takes place with an addition rate of 1.2 l/min. Then the rest of the solution will be added with 100% progression during 30 minutes.

After further 15 minutes the dyeing is finished. In spite of more difficult dyeing conditions with a relative short treatment time an even olive-green yarn will be achieved without remarks which is suitable for manufacturing of a uni-fabrics.

EXAMPLE 4

In a winch dyeing machine without bath circulation 200 kg cotton interlock will be dyed in a bath relationship of 1:20. The bath is supplied with 60 g/l sodium chloride and—after complete distribution—3% C.I. Nr. 20505 Reactive Black 5 and 0.65% of the dyeing agent having the formula

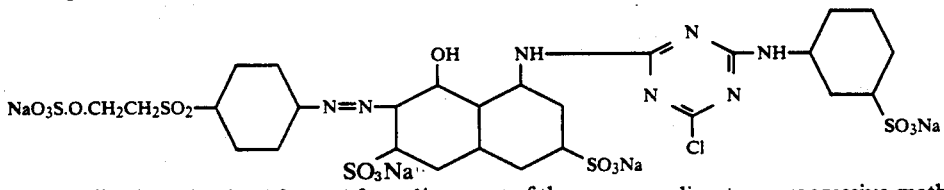

are supplied in a dissolved form. After adjustment of the dyeing temperature to 40° C. 100 l alkali solution, which contains 1.5 $cm^3$/l liquid caustic soda 50° Bé (counted on the total volume of 4000 l) is added in such a way that at 45 minutes total addition time the programme change takes place after 25 minutes. At first an addition characteristic of 60% progression is performed which after 25 minutes is interrupted after which with the remaining alkali solution a complete addition programme with 80% progression solution takes place during the remaining time of 20 minutes. 20 minutes after the end of the addition process the dyeing is finished. One achieves a deep marine blue with perfect evenness at a short total dyeing time.

If one compares this addition characteristic by means of progression change obtained with the addition characteristic considered as previous optimal standard, which is obtained with 60% progression over 60 minutes addition time one can state that the new addition characteristic obtained by means of progression change follows the standard to almost 40 minutes. Not until then the rest of the alkali will be added over proportionally rapidly. In this way the previous fixation characteristic is maintained in a large extent which however reduces in a high degree the levelling of the fixation characteristic which leads to unnecessary prolongation of dyeing time.

I claim:

1. In the process for the level dyeing on material made at least partly of cellulosic fibers, in an aqueous medium and by an exhaust technique with a reactive dye which is fixable onto the textile material under alkaline conditions, an alkali for the fixation of the reactive dye being gradually added at a fixing temperature to the aqueous medium which contains the fabric material, in a substantially continuous manner according to a mathematical function obtained by varying a rate of alkali addition as a function of time during a time interval during which a sufficient amount of alkali is added to complete fixation of the reactive dye, an improvement comprising:

initially adding the alkali to the aqueous medium at a first rate of alkali addition which varies as a first function of time according to a first mathematical non-parabolic function during an initial predetermined portion of the time interval required to complete the fixing process;

adding additional alkali to the aqueous medium by abruptly changing to a second rate of alkali addition from said first rate of alkali addition, which said second rate of alkali addition is different from the first rate of alkali addition, and which said second rate of alkali addition varies as at least a second function of time according to at least a second non-parabolic mathematical function during a remaining predetermined portion of the time interval required to complete the fixing process, wherein a combination of said first mathematical function and said at least a second mathematical function results in a non-parabolic function.

2. The process according to claim 1, wherein said first rate of alkali addition varies as a first function of time according to a progressive mathematical function.

3. The process according to claim 1, wherein said first rate of alkali addition varies as a first function of time according to a linear mathematical function.

4. The process according to claim 1, wherein said first rate of alkali addition varies as a first function of time according to a degressive mathematical function.

5. The process according to claim 1, wherein said at least one second rate of alkali addition varies as at least a second function of time according to a progressive mathematical function.

6. The process according to claim 2, wherein said at least one second rate of alkali addition varies as at least a second function of time according to a progressive mathematical function.

7. The process according to claim 1, wherein said initial predetermined portion of the time interval is from 15 to about 25 minutes, the first function of time varying as a 20% to 60% progressive mathematical function, said remaining predetermined portion of the time interval required to complete the fixing process varying as a 80% to 100% progressive mathematical function and being from 20 to 30 minutes.

8. The process according to claim 1, wherein the textile material comprises a mixture of cellulosic fibers and non-cellulosic fibers, the non-cellulosic fibers comprising synthetic fibers.

9. The process according to claim 2, wherein the reactive dye carries at least one group selected from the group consisting of vinylsulfon and vinylsulfonylphenylaminochlortriazin.

10. The process according to claim 9, wherein the alkali are selected from the group consisting of alkali metal hydroxides and alkali metal salts of carbonic acids, silicic acid or phosphoric acid.

11. The process according to claim 1, wherein the alkali are selected from the group consisting of alkali metal hydroxides, and alkali metal salts of carbonic, silicic acid or phosphoric acid.

12. The process according to claim 11, wherein the alkali comprise a mixture of different alkalis which are delivered to the aqueous medium.

* * * * *

UNITED STATES PATENT AND TRADEMARK OFFICE

CERTIFICATE OF CORRECTION

| | | |
|---|---|---|
| PATENT NO. | : | 5,114,427 |
| DATED | : | May 19, 1992 |
| INVENTOR(S) | : | Sture Damm |

certified that error appears in the above-identified patent and that said Letters Patent is hereby corrected as shown below:

On the title page, item:

Related U.S. Application Data

[63] Continuation of Ser.No. 262,154, Oct. 17, 1988, abandoned, which is a continuation of Ser.No. 13,626, Dec. 29, 1986, abandoned.

Signed and Sealed this

Seventeenth Day of August, 1993

Bruce Lehman

*Attest:*

BRUCE LEHMAN

*Attesting Officer*

*Commissioner of Patents and Trademarks*